US007210174B2

(12) United States Patent
Yeh

(10) Patent No.: US 7,210,174 B2
(45) Date of Patent: May 1, 2007

(54) CRASH HELMET THAT IS ASSEMBLED EASILY AND RAPIDLY

(76) Inventor: Ping Chang Yeh, No. 41, Gongye S. Road, Guantian Township, Tainan County (TW)

( * ) Notice: Subject to any disclaimer, the term of this patent is extended or adjusted under 35 U.S.C. 154(b) by 4 days.

(21) Appl. No.: 11/264,802

(22) Filed: Nov. 1, 2005

(65) Prior Publication Data

US 2006/0230507 A1 Oct. 19, 2006

(30) Foreign Application Priority Data

Apr. 13, 2005 (TW) ..... 94205718 U

(51) Int. Cl.
*A42B 1/08* (2006.01)

(52) U.S. Cl. ..... 2/424

(58) Field of Classification Search ..... 2/424
See application file for complete search history.

(56) References Cited

U.S. PATENT DOCUMENTS 5,461,731 A * 10/1995 Shida ..... 2/424
6,260,213 B1 * 7/2001 Eom et al. ..... 2/424
6,622,314 B1 * 9/2003 Kim et al. ..... 2/424
6,842,913 B1 * 1/2005 Song ..... 2/424
7,065,798 B2 * 6/2006 Kuo ..... 2/424
2002/0189005 A1 * 12/2002 Taniuchi ..... 2/424
2003/0182717 A1 * 10/2003 Choi et al. ..... 2/424
2003/0196255 A1 * 10/2003 Arai ..... 2/424
2006/0117467 A1 * 6/2006 Choi et al. ..... 2/424

* cited by examiner

*Primary Examiner*—Rodney M. Lindsey
(74) *Attorney, Agent, or Firm*—Alan D. Kamrath; Nikolai & Mersereau, P.A.

(57) ABSTRACT

A crash helmet includes a helmet body, a face mask, and a binding device for attaching the face mask to the helmet body. Thus, the face mask is mounted on and removed from the helmet body easily and rapidly by operation of the binding device, so that the crash helmet is assembled and disassembled easily and rapidly, thereby facilitating a user mounting and dismantling the crash helmet. In addition, the face mask is mounted on the helmet body by the binding device without needing a metallic spring to prevent the crash helmet from being inoperative during a long-term utilization, thereby enhancing the lifetime of the crash helmet.

15 Claims, 11 Drawing Sheets

CRASH HELMET THAT IS ASSEMBLED EASILY AND RAPIDLY

BACKGROUND OF THE INVENTION

1. Field of the Invention

The present invention relates to a crash helmet, and more particularly to a crash helmet that is assembled and disassembled easily and rapidly.

2. Description of the Related Art

A conventional crash helmet comprises a helmet body, a face mask pivotally mounted on the helmet body, and a binding device for attaching the face mask to the helmet body. The binding device includes a metallic spring to provide an elastic force. Thus, when the binding device is disposed at the locked state, the metallic spring is pressed to store a restoring force, and when the binding device is disposed at the unlocked state, the metallic spring provides the restoring force.

However, the metallic spring has an elastic feature, so that the metallic spring is not assembled easily, thereby causing inconvenience in assembly of the binding device of the crash helmet. In addition, the metallic spring easily produces an elastic fatigue during a long-term utilization, so that the binding device is inoperative when the metallic spring is worn out, thereby decreasing the lifetime of the crash helmet. Further, the metallic spring is easily rusted, thereby incurring a sanitary problem.

SUMMARY OF THE INVENTION

In accordance with the present invention, there is provided a crash helmet, comprising a helmet body, a face mask, and a binding device for attaching the face mask to the helmet body. The helmet body has two opposite sides each-formed with a mounting cavity. The face mask has two opposite sides each having an inner face provided with a protruding ring having a periphery formed with two arc-shaped protruding blocks, and a gap is defined between each of the two protruding blocks and the inner face of the face mask. The binding device is mounted in the mounting cavity of the helmet body and includes a fixed board and a movable board. The fixed board is formed with a through hole and provided with an elastic positioning arm having an outward extending protruding positioning block. The movable board has a first face formed with a circular protruding plate received in the through hole of the fixed board. The movable board has a second face formed with a circular receiving recess having a periphery formed with two opposite arc-shaped receiving grooves and two opposite arc-shaped catch plates. The protruding ring of the face mask is received in the receiving recess of the movable board, and the two protruding blocks of the face mask are extended through the two receiving grooves of the movable board. Each of the two catch plates of the movable board is locked in the gap of the respective protruding block of the face mask by rotation of the movable board. The movable board has a side provided with a frame having a side formed with a locking slot lockable on the positioning block of the fixed board by rotation of the movable board.

The primary objective of the present invention is to provide a crash helmet that is assembled and disassembled easily and rapidly.

Another objective of the present invention is to provide a crash helmet that is operated easily and conveniently.

A further objective of the present invention is to provide a crash helmet, wherein the face mask is mounted on and removed from the helmet body easily and rapidly by operation of the binding device, so that the crash helmet is assembled and disassembled easily and rapidly, thereby facilitating a user mounting and dismantling the crash helmet.

A further objective of the present invention is to provide a crash helmet, wherein the face mask is mounted on the helmet body by the binding device without needing a metallic spring to prevent the crash helmet from being inoperative during a long-term utilization, thereby enhancing the lifetime of the crash helmet.

A further objective of the present invention is to provide a crash helmet, wherein the crash helmet is made of plastic material, so that the crash helmet will not be rusted to prevent the crash helmet from being contaminated during a long-term utilization, thereby enhancing the lifetime of the crash helmet.

Further benefits and advantages of the present invention will become apparent after a careful reading of the detailed description with appropriate reference to the accompanying drawings.

DETAILED DESCRIPTION OF THE INVENTION

Figure 1:
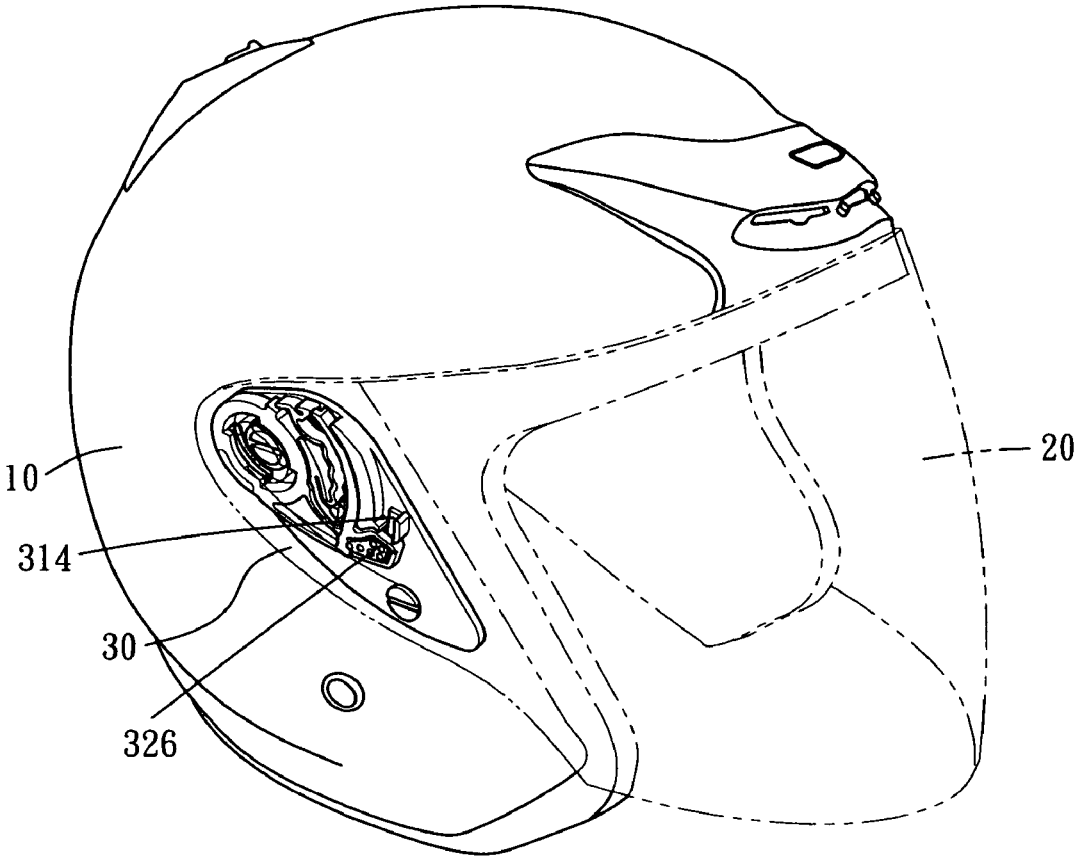
FIG. 1 is a perspective view of a crash helmet in accordance with the preferred embodiment of the present invention.
Figure 2:
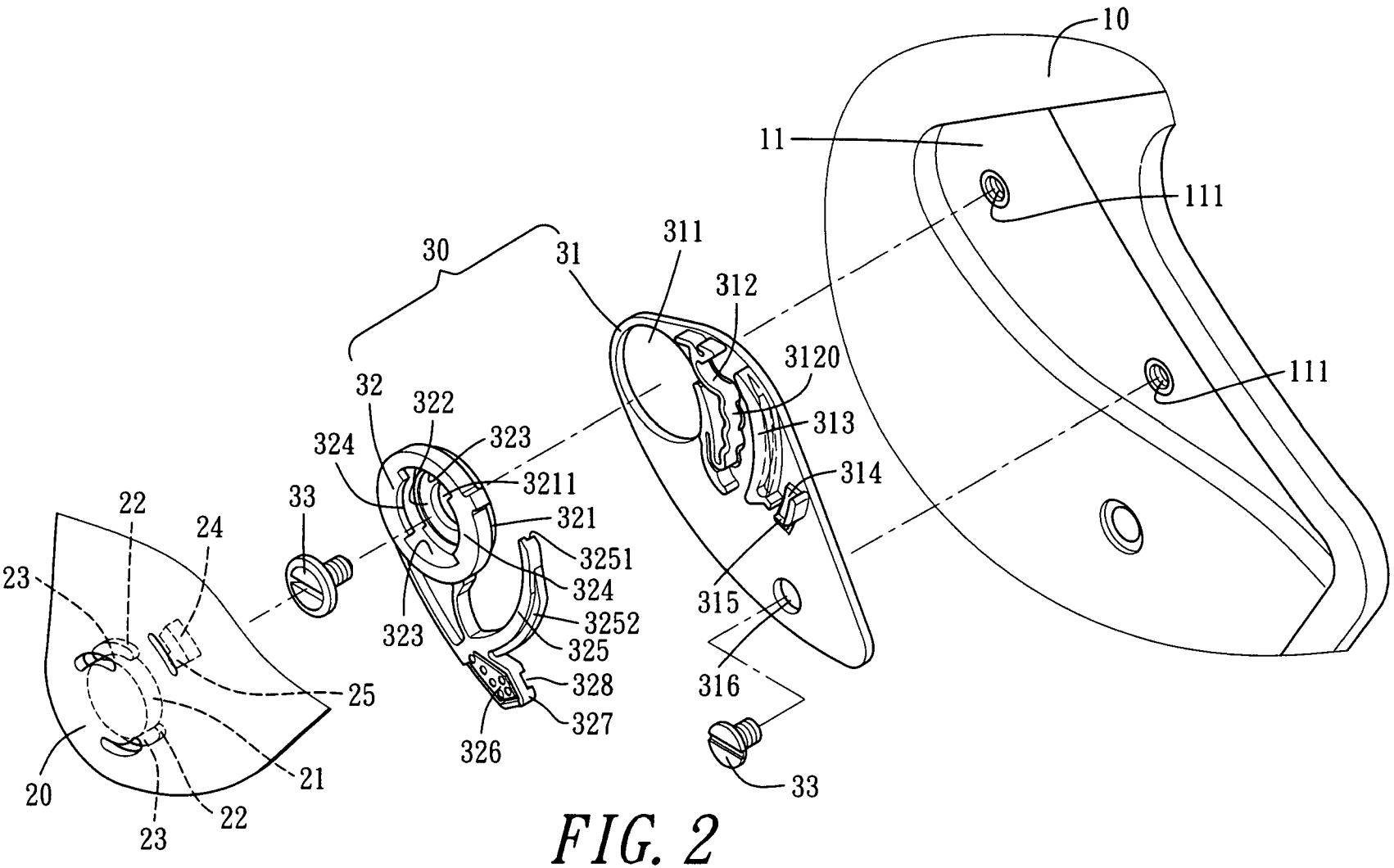
FIG. 2 is a partially exploded perspective view of the crash helmet as shown in FIG. 1.
Figure 3:
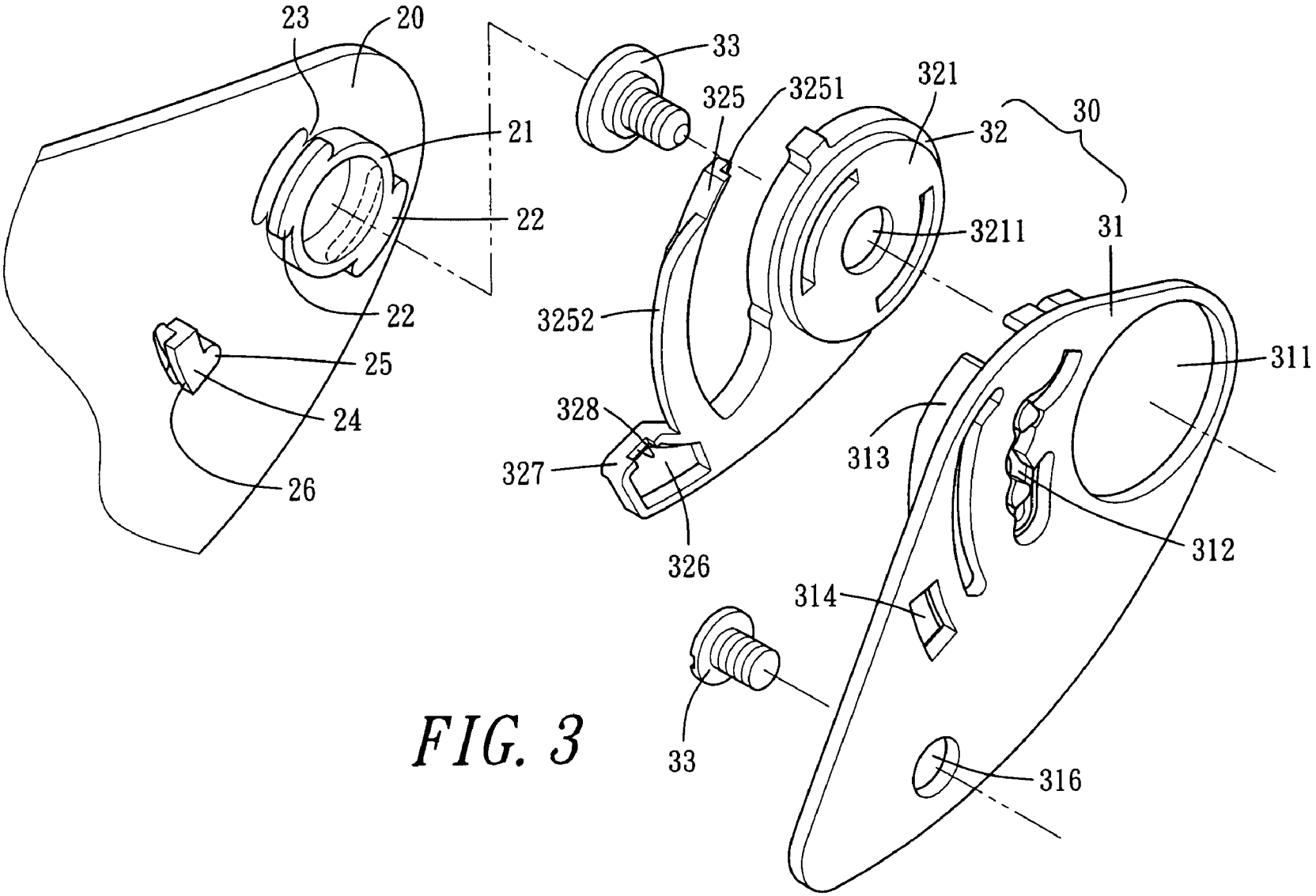
FIG. 3 is a partially exploded perspective view of the crash helmet as shown in FIG. 1.

Referring to the drawings and initially to FIGS. 1–3, a crash helmet in accordance with the preferred embodiment of the present invention comprises a helmet body 10, a face mask 20, and a binding device 30 for attaching the face mask 20 to the helmet body 10.

The helmet body 10 is placed on a user's head and has two opposite sides each formed with a mounting cavity 11 (see FIG. 2) having two screw bores 111.

The face mask 20 is an arc-shaped transparent plate to shield the user's face. The face mask 20 has two opposite sides each having an inner face provided with an inwardly extended protruding ring 21 having a periphery integrally formed with two arc-shaped protruding blocks 22, and a gap 23 is defined between each of the two protruding blocks 22 and the inner face of the face mask 20. The inner face of the face mask 20 is provided with a protruding flange 24 located adjacent to the protruding ring 21. The protruding flange 24 of the face mask 20 has a first side formed with a protruding edge 25 facing the protruding ring 21 and a second side formed with an arc-shaped locking block 26.

The binding device 30 includes a fixed board 31 and a movable board 32.

The fixed board 31 has a first end formed with a through hole 311 aligning with one of the two screw bores 111 of the helmet body 10 and a second end formed with a through bore 316 aligning with the other one of the two screw bores 111 of the helmet body 10. The fixed board 31 has a mediate portion provided with an adjusting arm 312 located adjacent to the through hole 311, an inwardly curved arc-shaped slide track 313 located adjacent to the adjusting arm 312 and an elastic positioning arm 314 located adjacent to a distal end of the slide track 313. The adjusting arm 312 is integrally formed on the fixed board 31 so that the adjusting arm 312 has a resilient feature and can be restored automatically when being pressed and deflected. The adjusting arm 312 has a face formed with a plurality of adjusting depressions 3120. The positioning arm 314 has a first end connected to the fixed board 31 and a second end formed with an outward extending protruding positioning block 315.

The movable board 32 has a first face formed with a circular protruding plate 321 received in the through hole 311 of the fixed board 31 and having a central hole 3211 aligning with one of the two screw bores 111 of the helmet body 10. The movable board 32 has a second face formed with a circular receiving recess 322 having a periphery formed with two opposite arc-shaped receiving grooves 323 and two opposite arc-shaped catch plates 324 located between the two receiving grooves 323. Thus, the protruding ring 21 of the face mask 20 is received in the receiving recess 322 of the movable board 32, and the two protruding blocks 22 of the face mask 20 are extended through the two receiving grooves 323 of the movable board 32 and stopped by the two catch plates 324 of the movable board 32 by rotation of the movable board 32. In addition, each of the two catch plates 324 of the movable board 32 is locked in the gap 23 of the respective protruding block 22 of the face mask 20. The movable board 32 has a side provided with an upward extending arc-shaped extension arm 325 having an inner side formed with an arc-shaped locking groove 3251 and an outer side integrally formed with a slide plate 3252 having a smaller height and slidable into the slide track 313 of the fixed board 31. The extension arm 325 of the movable board 32 has a root portion provided with a frame 327 and an elastic press plate 326 received in the frame 327 and having an end connected to the extension arm 325 and a side depending in the frame 327 and rested on the positioning block 315 of the fixed board 31. The frame 327 of the movable board 32 has a side formed with a locking slot 328.

Figure 4:
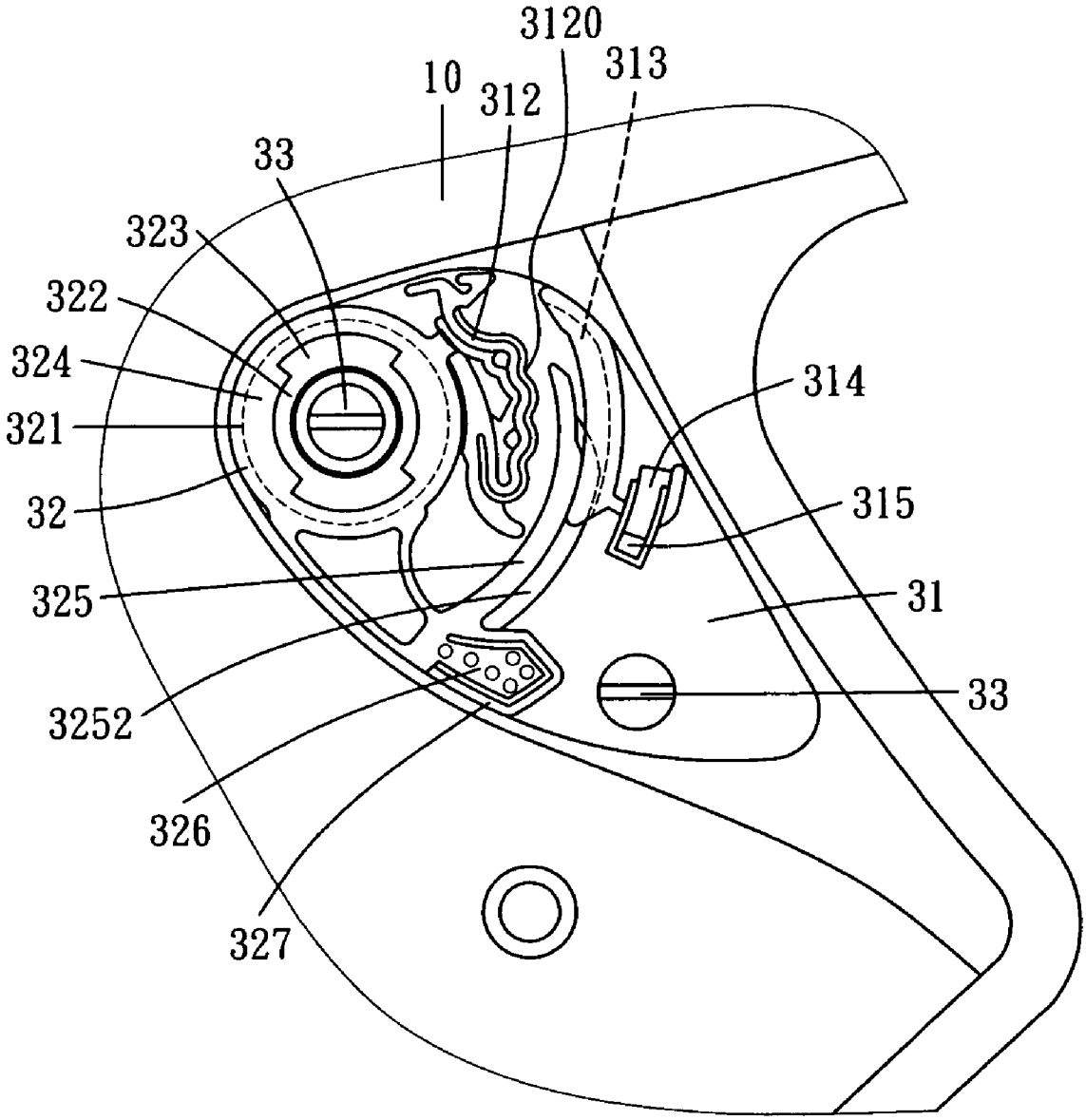
FIG. 4 is a side plan view of the crash helmet as shown in FIG. 1.

In assembly, referring to FIGS. 1–11, the protruding plate 321 of the movable board 32 is received in the through hole 311 of the fixed board 31 and the distal end of the slide plate 3252 of the movable board 32 is slidable into the slide track 313 of the fixed board 31 so that the fixed board 31 is combined with the movable board 32 to form the binding device 30. Then, the binding device 30 is mounted in the mounting cavity 11 of the helmet body 10. Then, two screw members 33 are respectively extended through the central hole 3211 of the movable board 32 and the through bore 316 of the fixed board 31 and screwed into the two screw bores 111 of the helmet body 10, so that the fixed board 31 is secured in the mounting cavity 11 of the helmet body 10, and the movable board 32 is rotatable about the respective screw member 33 that is extended through the central hole 3211 of the movable board 32, thereby forming a state as shown in FIG. 4.

Figure 5:
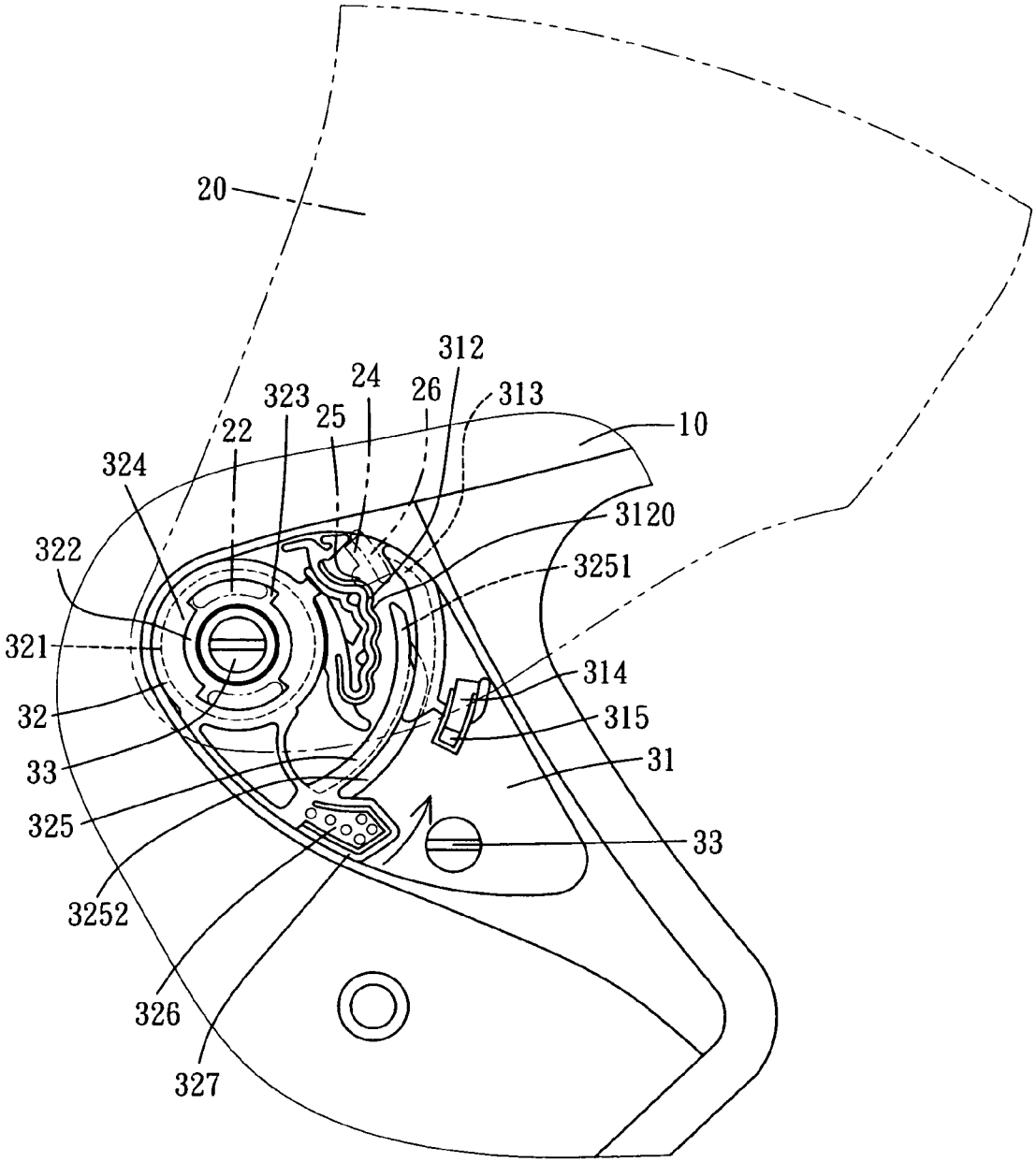
FIG. 5 is a schematic operational view of the crash helmet as shown in FIG. 4.

Then, as shown in FIG. 5, the protruding ring 21 of the face mask 20 is received in the receiving recess 322 of the movable board 32, the two protruding blocks 22 of the movable board 32 are extended through the two receiving grooves 323 of the movable board 32, and the protruding edge 25 of the protruding flange 24 of the face mask 20 is received in the uppermost one of the adjusting depressions 3120 of the adjusting arm 312.

Figure 6:
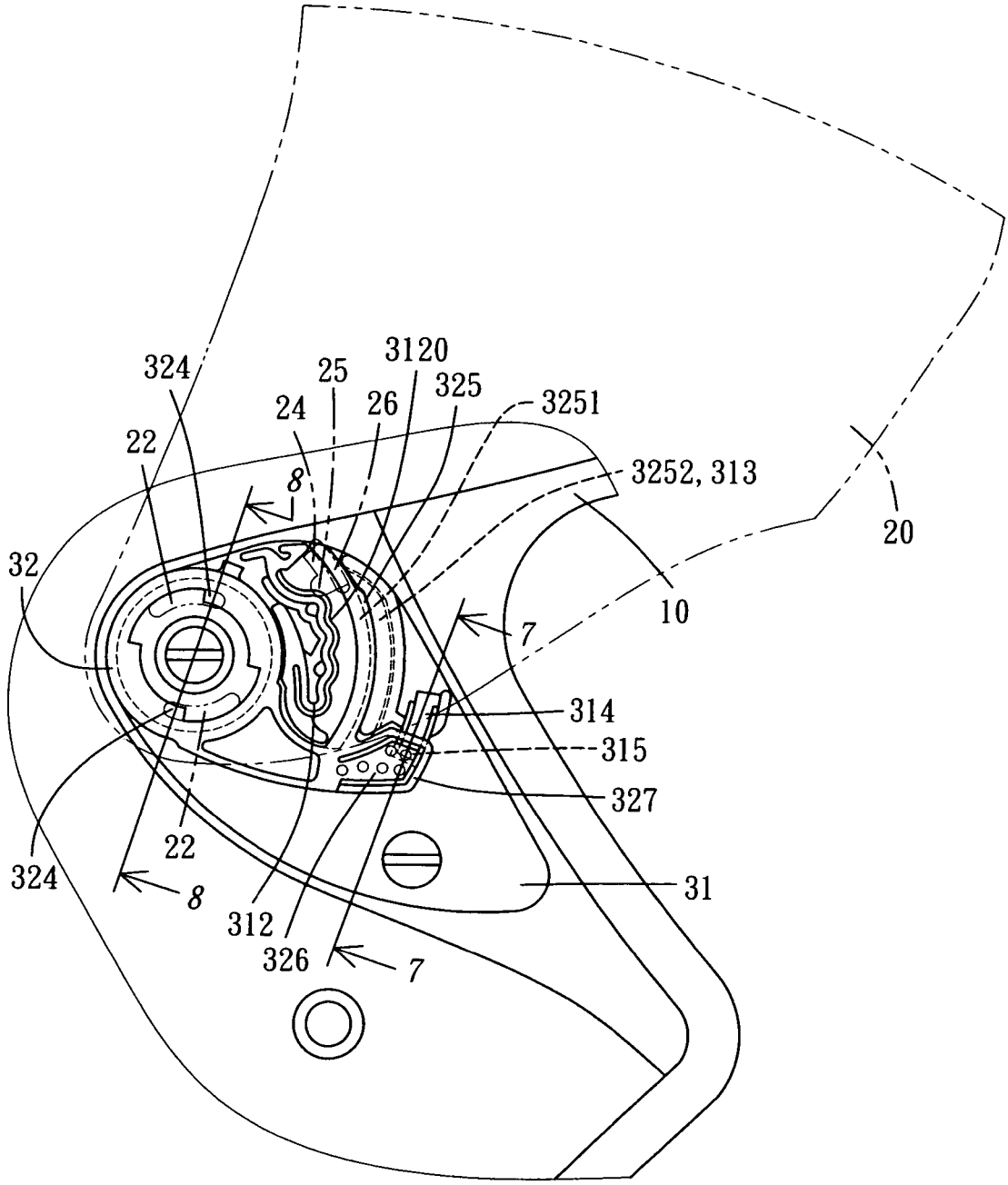
FIG. 6 is a schematic operational view of the crash helmet as shown in FIG. 5.
Figure 7:
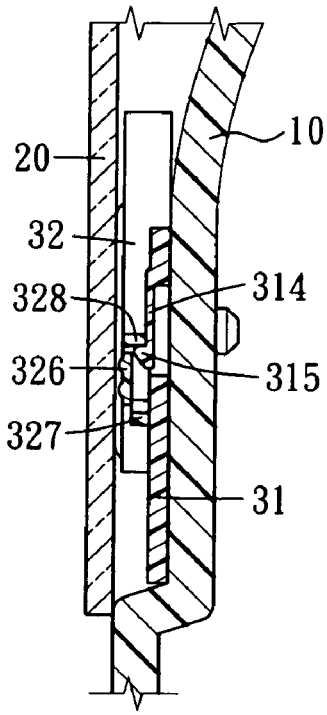
FIG. 7 is a plan cross-sectional view of the crash helmet taken along line 7—7 as shown in FIG. 6.

Then, the movable board 32 is rotatable about the respective screw member 33 to push the frame 327 toward the positioning arm 314 as indicated by the arrow shown in FIG. 5, until the locking slot 328 of the frame 327 is locked on the positioning block 315 of the positioning arm 314 as shown in FIG. 7, thereby forming a locking state as shown in FIG. 6. It is appreciated that, the positioning block 315 is lowered when being pressed to allow passage of the locking slot 328 and is then restored to lock the locking slot 328.

Figure 8:
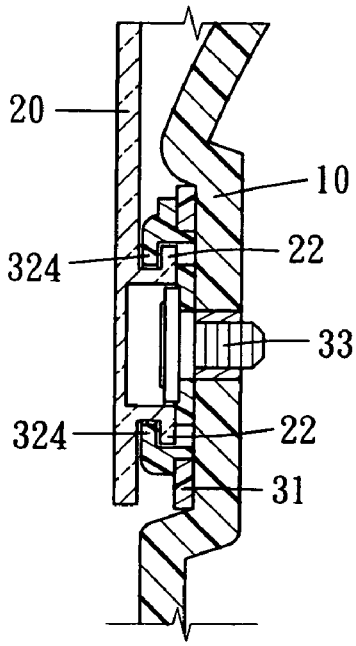
FIG. 8 is a plan cross-sectional view of the crash helmet taken along line 8—8 as shown in FIG. 6.

In such a manner, each of the two catch plates 324 of the movable board 32 is inserted into and locked in the gap 23 of the respective protruding block 22 of the face mask 20 by rotation of the movable board 32, so that the two protruding blocks 22 of the face mask 20 are stopped by the two catch plates 324 of the movable board 32, thereby locking the face mask 20 on the movable board 32 as shown in FIG. 8. At this time, the locking block 26 of the face mask 20 is inserted into and locked in the locking groove 3251 of the extension arm 325 of the movable board 32, thereby locking the face mask 20 on the movable board 32 doubly. Then, the slide plate 3252 of the movable board 32 is slidable into the slide track 313 of the fixed board 31, thereby forming an interlocking effect.

Figure 10:
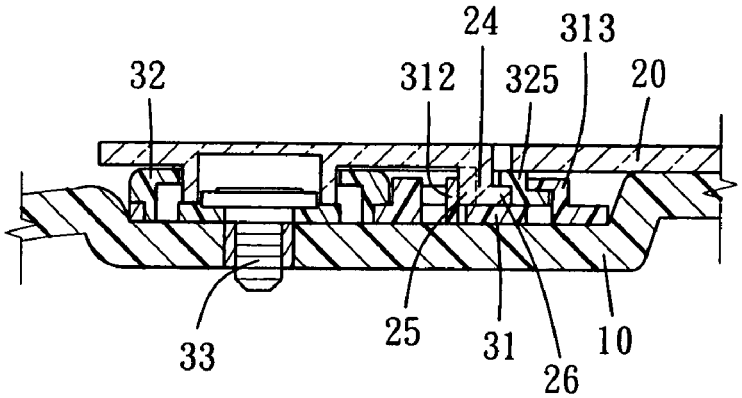
FIG. 10 is a plan cross-sectional view of the crash helmet taken along line 10—10 as shown in FIG. 9.
Figure 9:
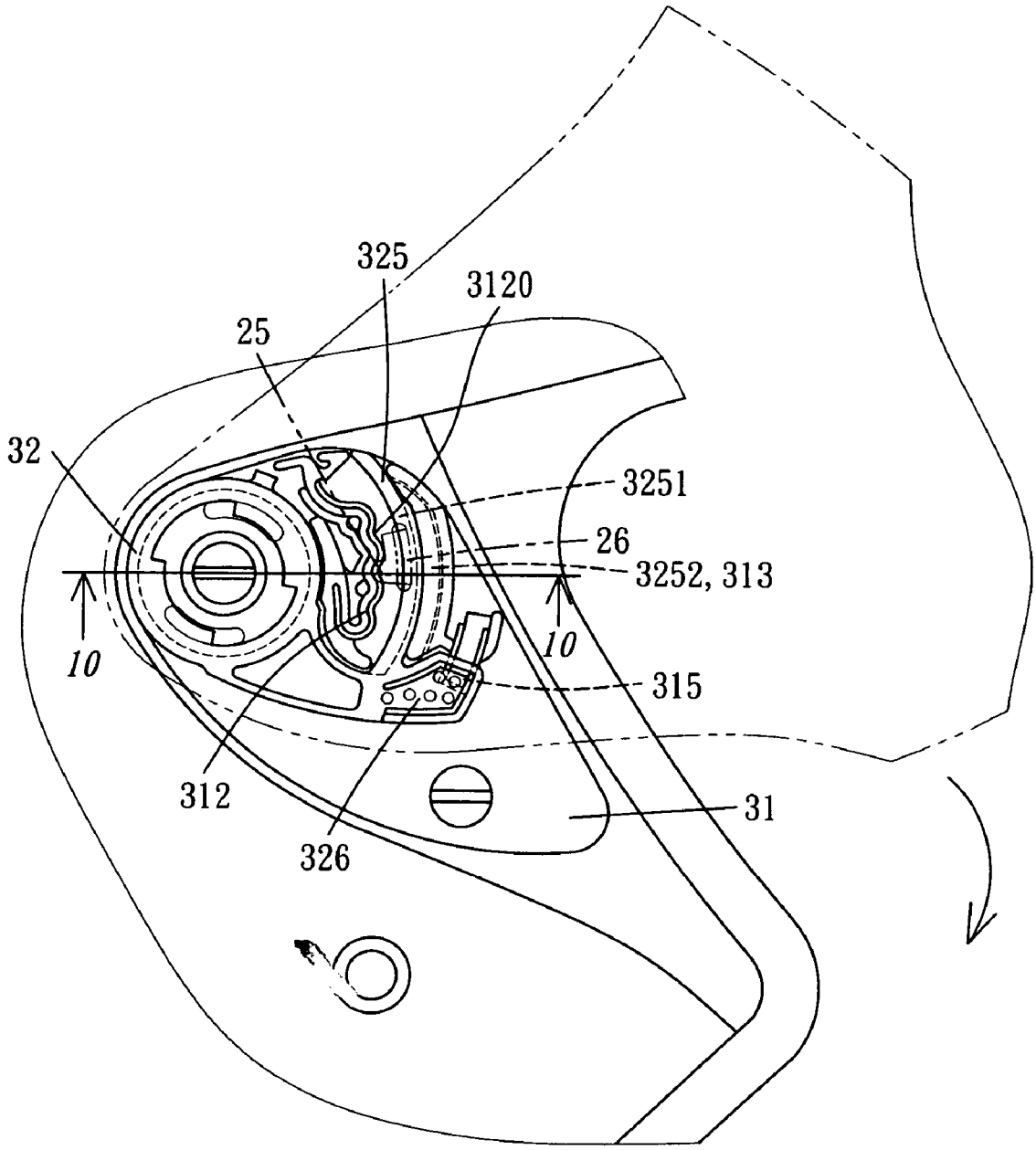
FIG. 9 is a schematic operational view of the crash helmet as shown in FIG. 6.
Figure 11:
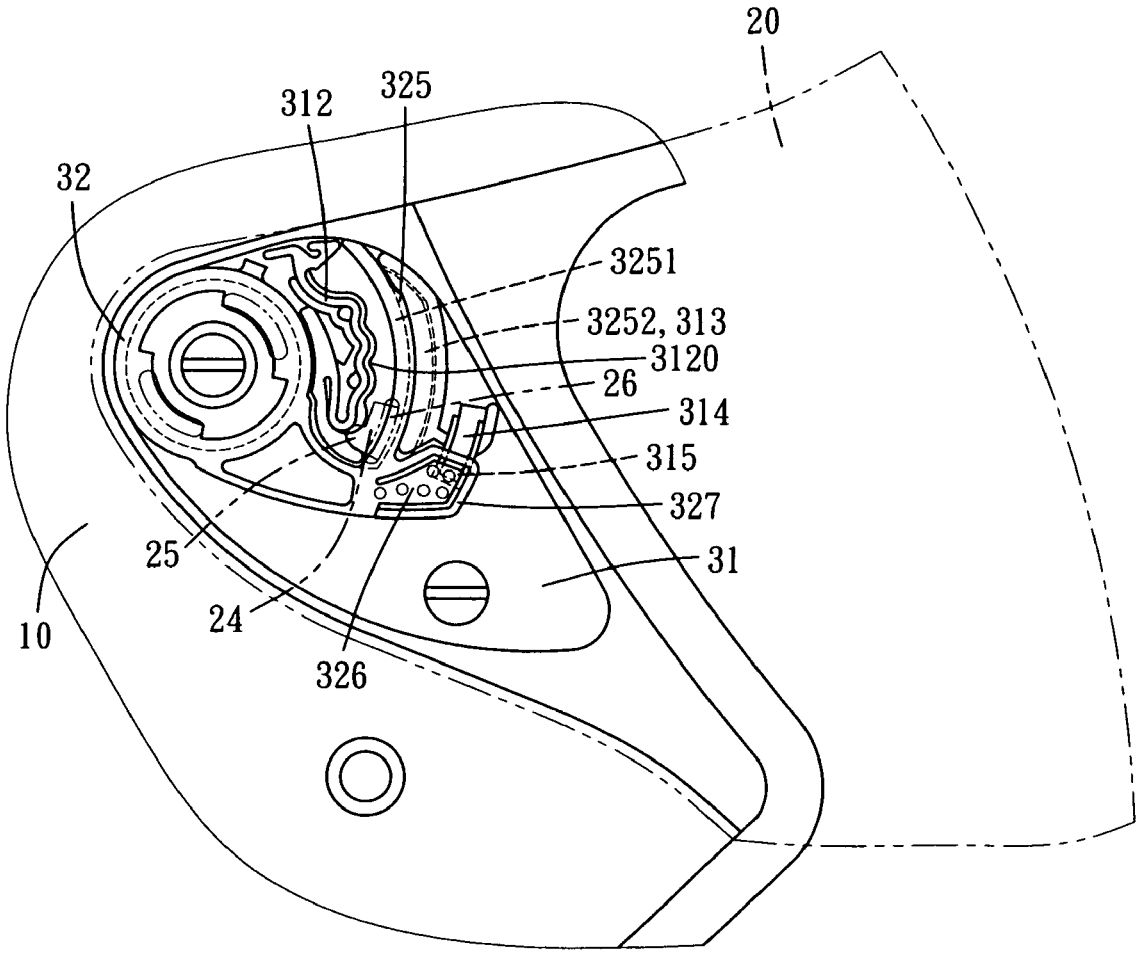
FIG. 11 is a schematic operational view of the crash helmet as shown in FIG. 9.

Then, the face mask 20 is pushed to move downward in a stepwise manner, so that the protruding edge 25 of the protruding flange 24 of the face mask 20 is movable in the adjusting depressions 3120 of the adjusting arm 312 of the fixed board 31 to adjust the optimum position of the face mask 20. As shown in FIG. 9, the protruding edge 25 of the protruding flange 24 of the face mask 20 reaches the intermediate one of the adjusting depressions 3120 of the adjusting arm 312 of the fixed board 31, thereby forming a state as shown in FIG. 10. Then, the face mask 20 is pushed to move downward successively, so that the protruding edge 25 of the protruding flange 24 of the face mask 20 reaches the lowermost one of the adjusting depressions 3120 of the adjusting arm 312 of the fixed board 31, thereby forming a state as shown in FIG. 11. At this time, the face mask 20 covers the whole front face of the helmet body 10.

Figure 13:
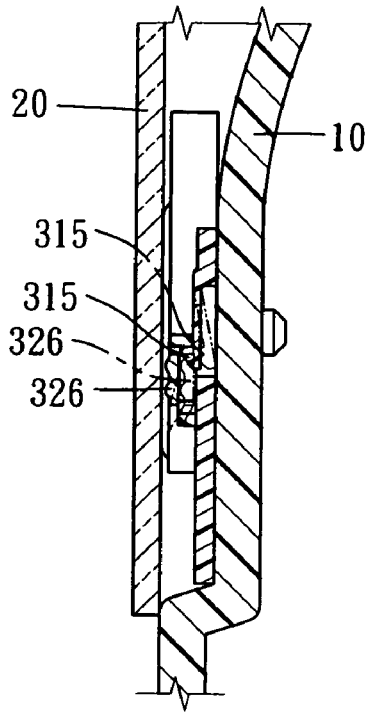
FIG. 13 is a plan cross-sectional view of the crash helmet taken along line 13—13 as shown in FIG. 12.
Figure 12:
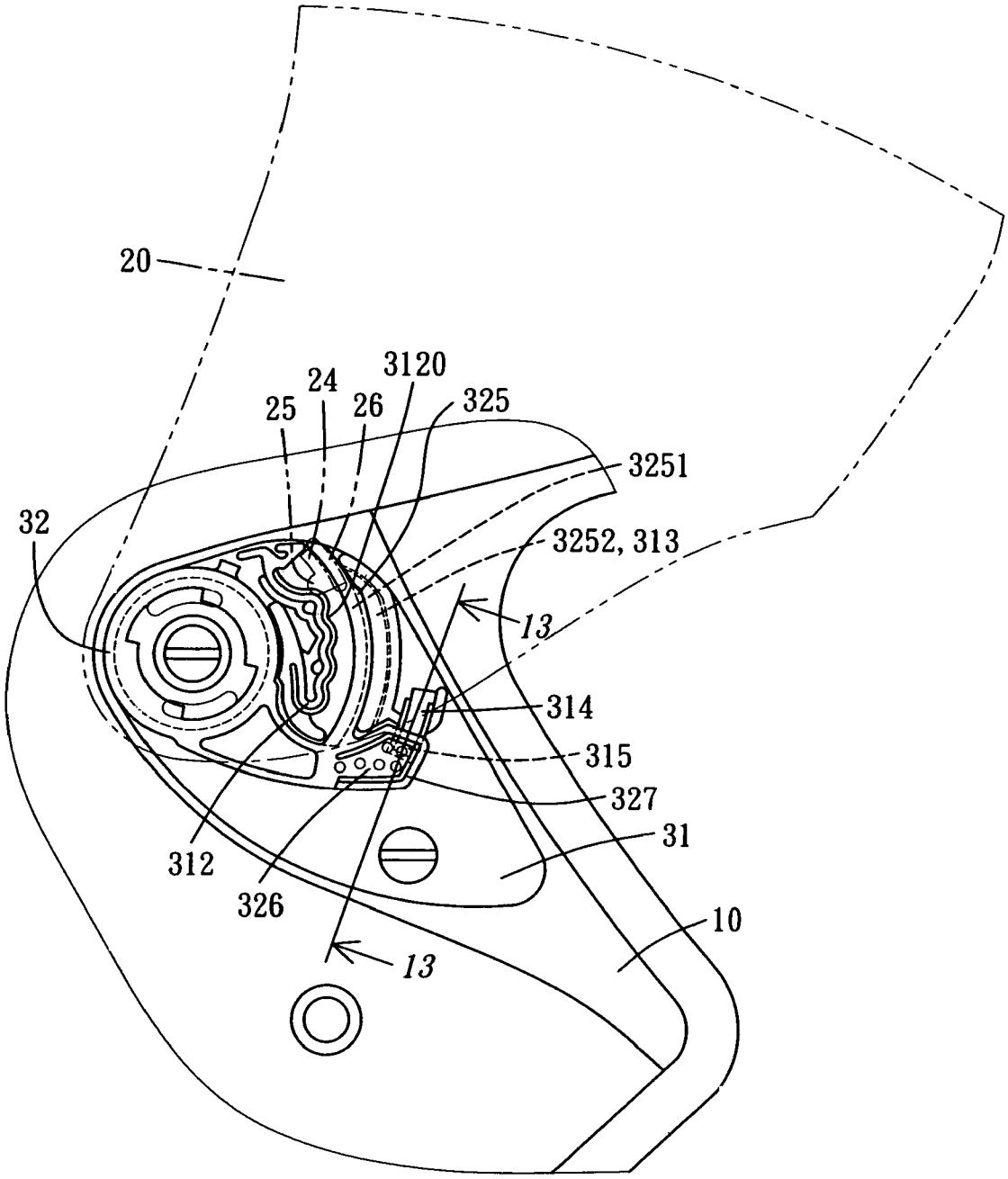
FIG. 12 is a schematic operational view of the crash helmet as shown in FIG. 11.
Figure 14:
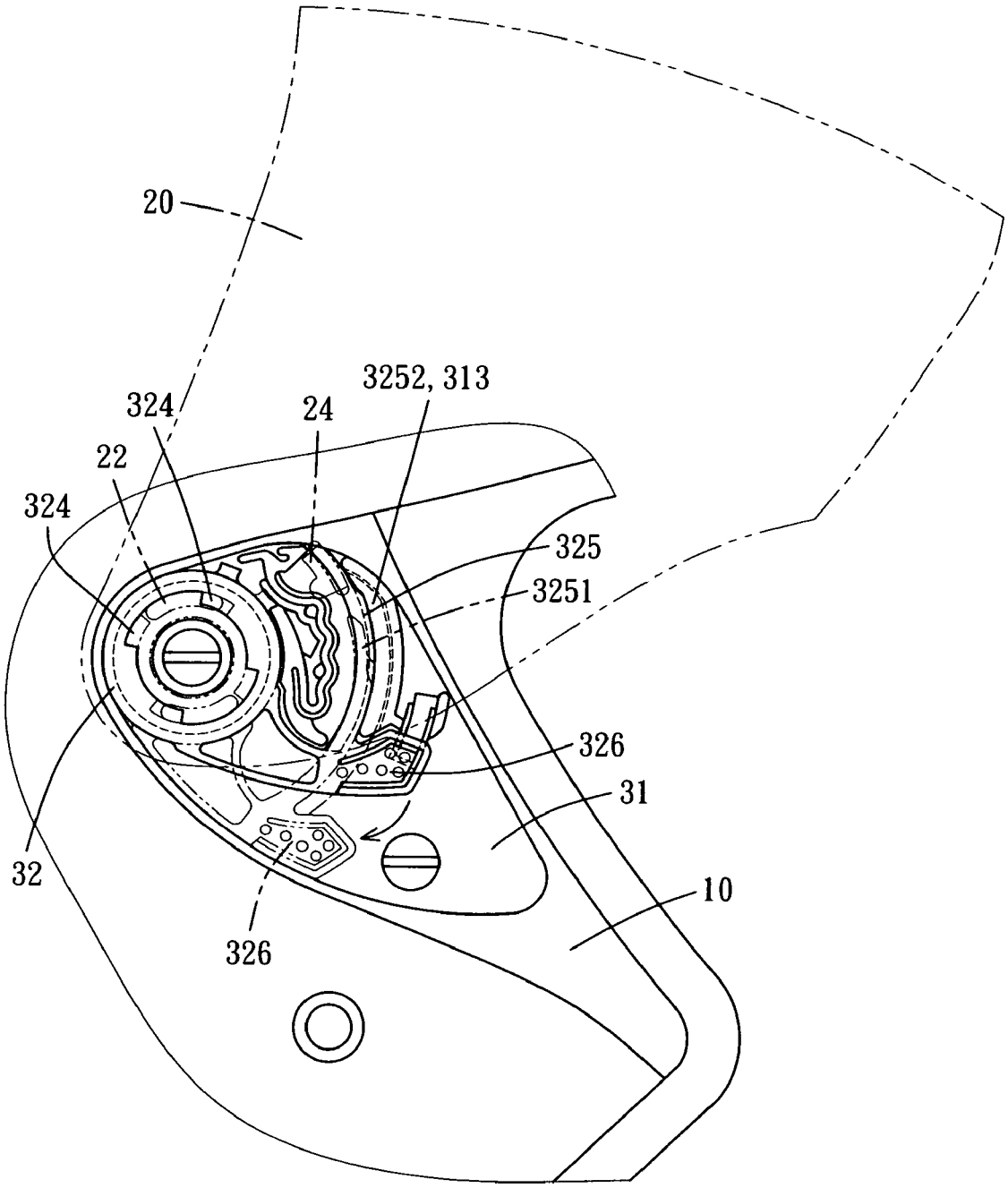
FIG. 14 is a schematic operational view of the crash helmet as shown in FIG. 12.

In detachment, referring to FIGS. 12–14, when a user wishes to detach the face mask 20 from the helmet body 10, the face mask 20 is pushed to move upward until the protruding edge 25 of the protruding flange 24 of the face mask 20 reaches the uppermost one of the adjusting depressions 3120 of the adjusting arm 312 of the fixed board 31 as shown in FIG. 12. Then, the elastic press plate 326 of the movable board 32 is pressed toward the positioning block 315 of the fixed board 31 to push the positioning block 315 of the fixed board 31 to detach from the locking slot 328 of the movable board 32 as shown in FIG. 13, thereby unlocking the movable board 32 from the fixed board 31, so that the movable board 32 is freely rotatable about the respective screw member 33 as shown in FIG. 14. In such a manner, each of the two catch plates 324 of the movable board 32 is detached from the gap 23 of the respective protruding block 22 of the face mask 20 by rotation of the movable board 32, so that the two protruding blocks 22 of the face mask 20 are detached from the two catch plates 324 of the movable board 32, thereby unlocking the face mask 20 from the movable board 32 as shown in FIG. 5. Thus, the face mask 20 is removed from the helmet body 10 easily and rapidly.

Accordingly, the face mask 20 is mounted on and removed from the helmet body 10 easily and rapidly by operation of the binding device 30, so that the crash helmet is assembled and disassembled easily and rapidly, thereby facilitating a user mounting and dismantling the crash helmet. In addition, the face mask 20 is mounted on the helmet body 10 by the binding device 30 without needing a metallic spring to prevent the crash helmet from being inoperative during a long-term utilization, thereby enhancing the lifetime of the crash helmet. Further, the crash helmet is made of plastic material, so that the crash helmet will not be rusted to prevent the crash helmet from being contaminated during a long-term utilization, thereby enhancing the lifetime of the crash helmet.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A crash helmet, comprising a helmet body, a face mask, and a binding device for attaching the face mask to the helmet body, wherein the helmet body has two opposite sides each formed with a mounting cavity;

the face mask has two opposite sides each having an inner face provided with a protruding ring having a periphery formed with two arc-shaped protruding blocks, and a gap is defined between each of the two protruding blocks and the inner face of the face mask;

the binding device is mounted in the mounting cavity of the helmet body and includes a fixed board and a movable board;

the fixed board is formed with a through hole and provided with an elastic positioning arm having an outward extending protruding positioning block;

the movable board has a first face formed with a circular protruding plate received in the through hole of the fixed board;

the movable board has a second face formed with a circular receiving recess having a periphery formed with two opposite arc-shaped receiving grooves and two opposite arc-shaped catch plates;

the protruding ring of the face mask is received in the receiving recess of the movable board, and the two protruding blocks of the face mask are extended through the two receiving grooves of the movable board;

each of the two catch plates of the movable board is locked in the gap of the respective protruding block of the face mask by rotation of the movable board;

the movable board has a side provided with a frame having a side formed with a locking slot lockable on the positioning block of the fixed board by rotation of the movable board.

2. The crash helmet in accordance with claim 1, wherein the movable board is further provided with an elastic press plate received in the frame and rested on the positioning block of the fixed board.

3. The crash helmet in accordance with claim 1, wherein the two protruding blocks of the face mask are stopped by the two catch plates of the movable board by rotation of the movable board.

4. The crash helmet in accordance with claim 1, wherein the helmet body is placed on a user's head.

5. The crash helmet in accordance with claim 1, wherein the face mask is an arc-shaped transparent plate to shield the user's face.

6. The crash helmet in accordance with claim 1, wherein:

the fixed board is further provided with an adjusting arm located adjacent to the through hole, the adjusting arm has a face formed with a plurality of adjusting depressions;

the inner face of the face mask is provided with a protruding flange located adjacent to the protruding ring, the protruding flange of the face mask has a first side formed with a protruding edge facing the protruding ring and a second side formed with an arc-shaped locking block;

the protruding edge of the protruding flange of the face mask is movable in the adjusting depressions of the adjusting arm of the fixed board to adjust a position of the face mask.

7. The crash helmet in accordance with claim 6, wherein the protruding edge of the protruding flange of the face mask is received in an uppermost one of the adjusting depressions of the adjusting arm when the protruding ring of the face mask is received in the receiving recess of the movable board and the two protruding blocks of the face mask are extended through the two receiving grooves of the movable board.

8. The crash helmet in accordance with claim 6, wherein:

the fixed board is further provided with an inwardly curved arc-shaped slide track located adjacent to the adjusting arm;

the movable board has a side provided with an upward extending arc-shaped extension arm having an inner side formed with an arc-shaped locking groove and an outer side integrally formed with a slide plate slidable into the slide track of the fixed board.

9. The crash helmet in accordance with claim 8, wherein when the protruding plate of the movable board is received in the through hole of the fixed board, a distal end of the slide plate of the movable board is slidable into the slide track of the fixed board.

10. The crash helmet in accordance with claim 8, wherein when the locking slot of the movable board is lockable on the positioning block of the fixed board by rotation of the movable board, the locking block of the face mask is inserted into and locked in the locking groove of the extension arm of the movable board, and the slide plate of the movable board is slidable into the slide track of the fixed board.

11. The crash helmet in accordance with claim 1, wherein the extension arm of the movable board has a root portion provided with the frame.

12. The crash helmet in accordance with claim 2, wherein the elastic press plate has an end connected to the frame and a side depending in the frame.

13. The crash helmet in accordance with claim 1, wherein the fixed board is secured in the mounting cavity of the helmet body.

14. The crash helmet in accordance with claim 1, wherein the protruding plate of the movable board is rotatable in the through hole of the fixed board by a screw member.

15. The crash helmet in accordance with claim 14, wherein the mounting cavity has a screw bore, the protruding plate of the movable board has a central hole, and the screw member is extended through the central hole of the movable board and screwed into the screw bore of the helmet body.

* * * * *